US005107544A

United States Patent [19]

Capatosto

[11] Patent Number: 5,107,544

[45] Date of Patent: Apr. 28, 1992

[54] ICE HOCKEY GOALIE GLOVE CONSTRUCTION

[76] Inventor: Marc A. Capatosto, 2668 Niagara Ave., Niagara Falls, N.Y. 13305

[21] Appl. No.: 541,736

[22] Filed: Jun. 19, 1990

[51] Int. Cl.[5] ..... A41D 13/10

[52] U.S. Cl. ..... 2/16; 2/161 A

[58] Field of Search ..... 2/16, 18, 161 A, 159, 2/160, DIG. 6

[56] References Cited

U.S. PATENT DOCUMENTS

| | | | |
|---|---|---|---|
| 1,841,193 | 1/1932 | Lidston | 2/16 |
| 3,626,515 | 12/1971 | Murray | 2/16 |
| 4,027,339 | 6/1977 | Brucker | 2/16 |
| 4,137,572 | 2/1979 | Jansson et al. | 2/161 A X |
| 4,417,359 | 11/1983 | Johnson | 2/161 A |
| 4,700,404 | 10/1987 | Lespérance | 2/161 A X |
| 4,864,658 | 9/1989 | Russell et al. | 2/160 |
| 4,967,418 | 11/1990 | Marcotte | 2/16 |

*Primary Examiner*—Werner H. Schroeder
*Assistant Examiner*—Sara M. Current
*Attorney, Agent, or Firm*—Bean, Kauffman & Spencer

[57] ABSTRACT

A glove construction for use by a hockey goalie includes a padded back structure, a removable close-fitting glove component, and flexible fittings to attach the inner glove to the padded back construction in a firm and secure manner yet retaining the necessary flexibility to perform the athletic operations required of a goalie.

19 Claims, 3 Drawing Sheets

ICE HOCKEY GOALIE GLOVE CONSTRUCTION

FIELD OF INVENTION

The disclosed device is within the field of athletic equipment, specifically equipment for use in playing ice hockey, and more specifically equipment for use in playing the goalie position in ice hockey.

BACKGROUND OF INVENTION

Athletic equipment in every sport, especially in professional sports, is evolving rapidly as new materials and construction techniques for both operating and protective equipment are developed. Protective gear especially often needs to be a cross or a compromise between efficient operability that will not hinder the natural body movements required of athletic performance and, on the other hand, the covering and thick padding that is often required for protection of the body of the athlete. This is especially true in the game of ice hockey which is fast moving, energetic, and highly dangerous, especially to the athlete playing the goalie position who must face a flurry of fast-moving target objects directed at him and intercept or block them. He also faces danger from collisions with other players, walls, metal goal structures, and sharp ice skate blades. There is great need to protect the body of the goalie, and in recent years a great variety of equipment and methods of construction of protective equipment for goalies has been produced. One type of equipment protects the goalie's hands and forearms, but the hand and forearm obviously must be unrestrained and unencumbered to the extent possible to enable the goalie to perform the catching and deflecting functions in rapid fashion that his duties require and that sets successful performance apart from failure.

A variety of protective constructions for a goalie's hands in the form of gloves in varying degrees of rigidity and resiliency have been designed and marketed. In recent years as durable fabric materials and efficient fastening mechanisms have come into use, more innovative designs have been made possible than could be achieved with the cumbersome and mostly rigid constructions formerly made from leather. The modern materials are more adaptable to innovative shapes and constructions that can improve the functionality of a protective construction without sacrificing protective ability. Again, this has been particularly true in glove constructions for hockey goalies which are of two types: the first is a "blocker" glove, which includes a large padded surface over the back of the hand and forearm and which is generally used to grasp the goalie's hockey stick; the other is a "catch" glove worn on the freehand, which has padding on both the back and palm side and large flexible surfaces to form a pocket in a mit shape for entrapping the hockey puck when possible. A particular problem that this invention seeks to solve in both these types of goalie gloves is that the massive outer construction must be mated to a inner glove that closely fits the user's hand such that detailed movement of the user's fingers will be transmitted without slack to the operating surfaces of the device. For instance, the goalie's blocker glove must securely grasp and control the hockey stick, and a close-fitting, usually soft leather, inner glove is typically permanently fastened within the massive outer structure for this purpose. The inner glove being in intimate contact with the body surface, however, will be subject to absorption of sweat during the athletic contest as the user exerts himself and the glove can additionally be stretched out of shape or damaged from the exertion. As the inner glove becomes uncomfortable, or wet, or actually damaged, the utility of the overall construction will decrease and, therefore, the user's efficiency and athletic performance will also decrease.

DESCRIPTION OF THE PRIOR ART

The prior devices marketed for use as ice hockey goalie gloves both in blocker and catch types have permanently affixed an inner close-fitting glove to the overall structure either by glue, rivets, stitching, lacing, or a combination of these fasteners. The inner glove is the component most likely to quickly deteriorate or become uncomfortable and dysfunctional by absorption of moisture. Since it is permanently affixed, the problem must be addressed in situ, and a typical way of doing this is between game periods, the equipment manager will remove the gloves from the goalie and insert an air blower device such as a hair dryer into the inner glove and attempt to remove the accumulated moisture by heat and air flow. While this can be effective, one other result is that the leather or leather-like material of the inner glove can become stiff and brittle and can also cause loss of function for that reason, and the life of the inner glove will be further decreased by cycling it between these wet and dry states. Eventually the entire glove will require complete disassembly and remanufacturing—an expensive and time-consuming process. The only other solution to the problem is to provide multiple sets of equipment for the goalie, which is too expensive in most circumstances.

Thus, it is an objective of the within invention to provide an ice hockey goalie glove that can provide the goalie at all times with a dry, fresh inner-glove construction that will enable efficient operation of the protective equipment.

A second objective of the within invention is to provide an ice hockey goalie glove that can be quickly and efficiently repaired when damaged and immediately reused.

A third objective of the within invention is to provide an ice hockey goalie glove that can be repaired quickly with no loss of its original construction integrity.

A fourth objective of the within invention is to provide an ice hockey goalie glove with an inner glove construction that will maximize the comfort to the user with no loss of function or protectiveness.

A fifth objective is to provide a goalie glove with replacement components that will avoid or delay the need for remanufacture of the entire device.

A final objective of the within invention is to provide an ice hockey goalie glove with interchangeable components to extend and maximize the life of the overall glove construction.

These and other objectives are achieved in novel fashion by the invention described below.

SUMMARY OF THE INVENTION

The hockey goalie glove construction described herein addresses this problem by providing a removable inner glove that can be quickly detached from the massive padded construction of the outer portions of the goalie glove, yet be firmly and securely reattached and restrained in the outer construction, retaining all of the required flexibility for efficient athletic performance and the necessary security to assure the protective function will not be diminished. Since the inner glove is removable, this addresses completely the problem of moisture absorption during the game, as the equipment manager may merely remove the wet or damaged inner glove and replace it with a fresh one. Although a wide variety of materials both for the outer protective construction and the inner glove could be used, these constructions can most conveniently be made from modern materials such as ballistic nylon for the rigid and padded outer constructions and soft leather or simulated leather for the inner glove construction, and by use of nylon or plastic fittings and hook-and-loop fastener straps such as velcro (TM). As will be seen in the description of the preferred embodiment which follows, your applicant has considered and rejected a great number of alternate constructions in favor of those that most efficiently accomplish the stated purposes.

DETAILED DESCRIPTION OF THE PREFERRED EMBODIMENT

Figure 1:
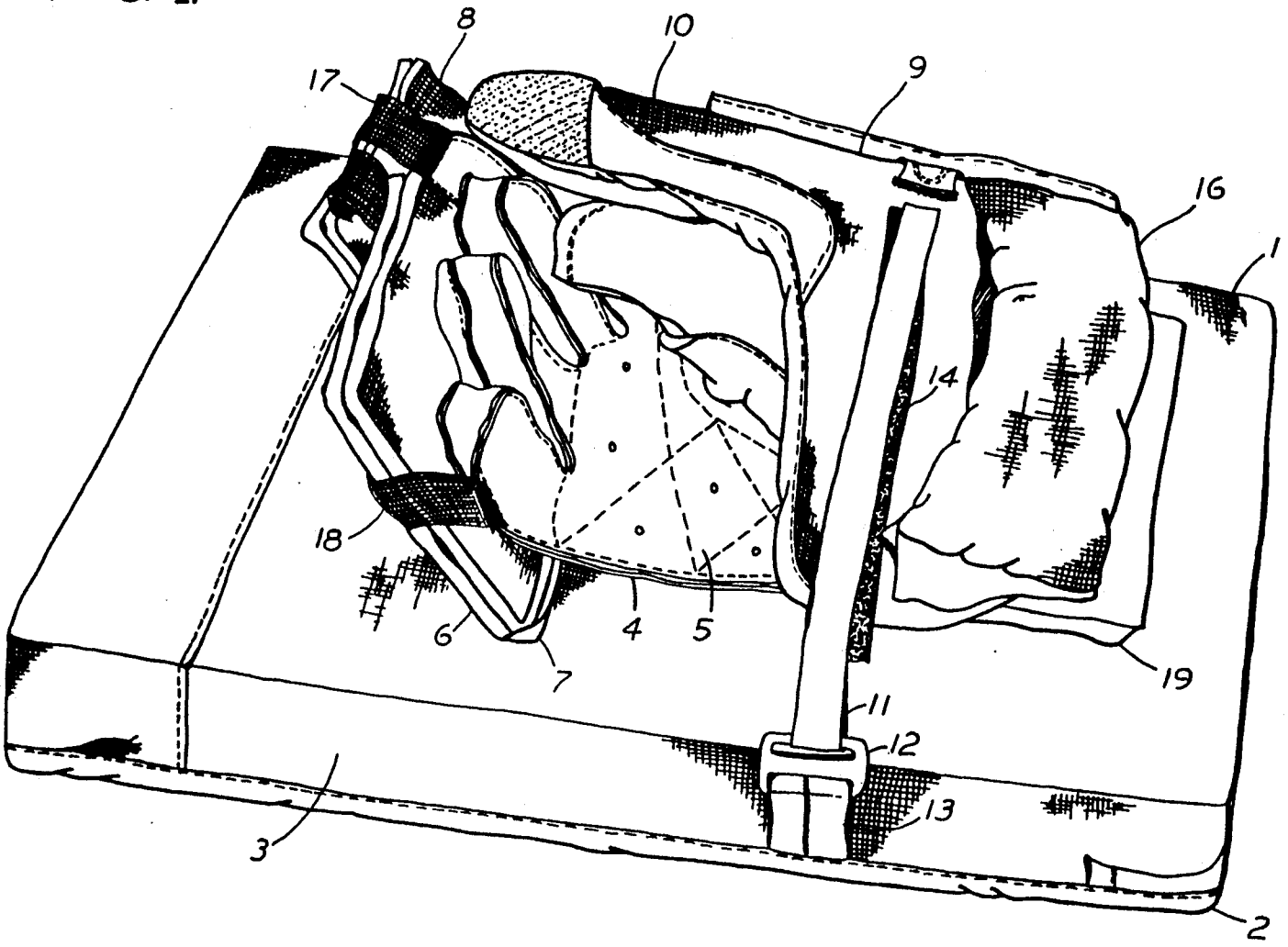
FIG. 1. is a perspective view of the glove side of the hockey goalie glove construction showing the inner glove affixed to the blocker pad assembly.

With reference to the drawings, it can be seen in the perspective view of FIG. 1 that a hockey goalie glove is constructed with a large padded blocker back 1 that can cover a major portion of the hand, wrist, and forearm and that may be of any convenient shape, but it is shown here as a rectangle with a regular thickness to contain foam or other padding material within the cover provided by the enclosed sewn construction of the back cover 2 and inside cover 3. The cover, of course, may be made of any conveniently durable and flexible material, but the preferred embodiment is made of a ballistic-type nylon that exhibits not only superior abrasion and tear resistance but can be conveniently cut and sewn in the manner of any fabric material. The design of modern hockey equipment devices such as this emphasizes use of fabric materials that can be cut to novel shapes without the limitations of traditional leather cover material. The inner close-fitting glove 4 is shown in affixed position with relation to the padded blocker back 1 and includes a padded and ventilated palm 5. In the preferred embodiment, the material of the inner glove may conveniently be soft, treated leather or a simulated leather or suitable cloth construction provided that the material will resist stretching in order to provide a close and secure fit to the user's hand throughout the duration of the athletic contest.

A phalangeal rotator pad (finger protector pad) 6 is attached to the blocker back 1 by a hinge 7 along one edge, typically a sewn fabric hinge, and the rotator pad 6 provides an attachment surface for the inner glove fingers yet enables free rotational movement of the fingers for grasping and operating the glove construction. A finger protector pad 8 is additionally provided and attached at the outer surface of the rotator pad 6.

An inner protector cover 9 is hinged to the blocker back 1, as will be shown in a later view, and includes a thumb cover extension 10 to provide extra padding over the sensitive wrist found in index finger regions. The inner protector is folded over the inner glove and retained in place by wrist strap 11, which is in turn connected to the side of the blocker glove opposite the hinge side via buckle 12 and a sewn retainer fitting 13. The wrist strap 11 is composed of a hook-and-loop material such as velcro (TM) and mates with mating strip 14 affixed by sewing to the protector cover 9. Additional wrist padding 16 is provided and fits over the wrist portion of the inner protector. The inner glove is retained within the blocker pad and protective cover in closed fashion additionally at the finger area by index finger restraining strap 17, also a hook-and-loop material, which is affixed to a mating strap at the back side of the finger protector and pinky finger restraining strap 18, also a hook-and-loop mating material. Also shown in FIG. 1 is a glove back extender pad 19, which extends over the back wrist area from the inner glove.

Thus, it can be seen that the inner glove will be securely restrained between the blocker back 1 and protector cover 9 at the wrist area and securely fastened by the wrist strap 11 and by the two finger straps 17 and 18 to the rotator pad 6. The inner glove is freely moveable so that it can grasp a hockey stick between the thumb and middle and ring finger and the index and pinky fingers can also be moved into grasping position with the rotator pad, which is moveable to the grasping position without losing any of its protective placement over the fingers. The thumb protector extension 10 also covers the hand in grasping position providing additional protection from impact injury. Further attachment of the inner glove to the blocker back is shown in later views, but it can be seen here that the inner glove is quickly removable by release of wrist strap 11 and finger straps 17 and 18 and replaced with a fresh inner glove construction.

Figure 2:
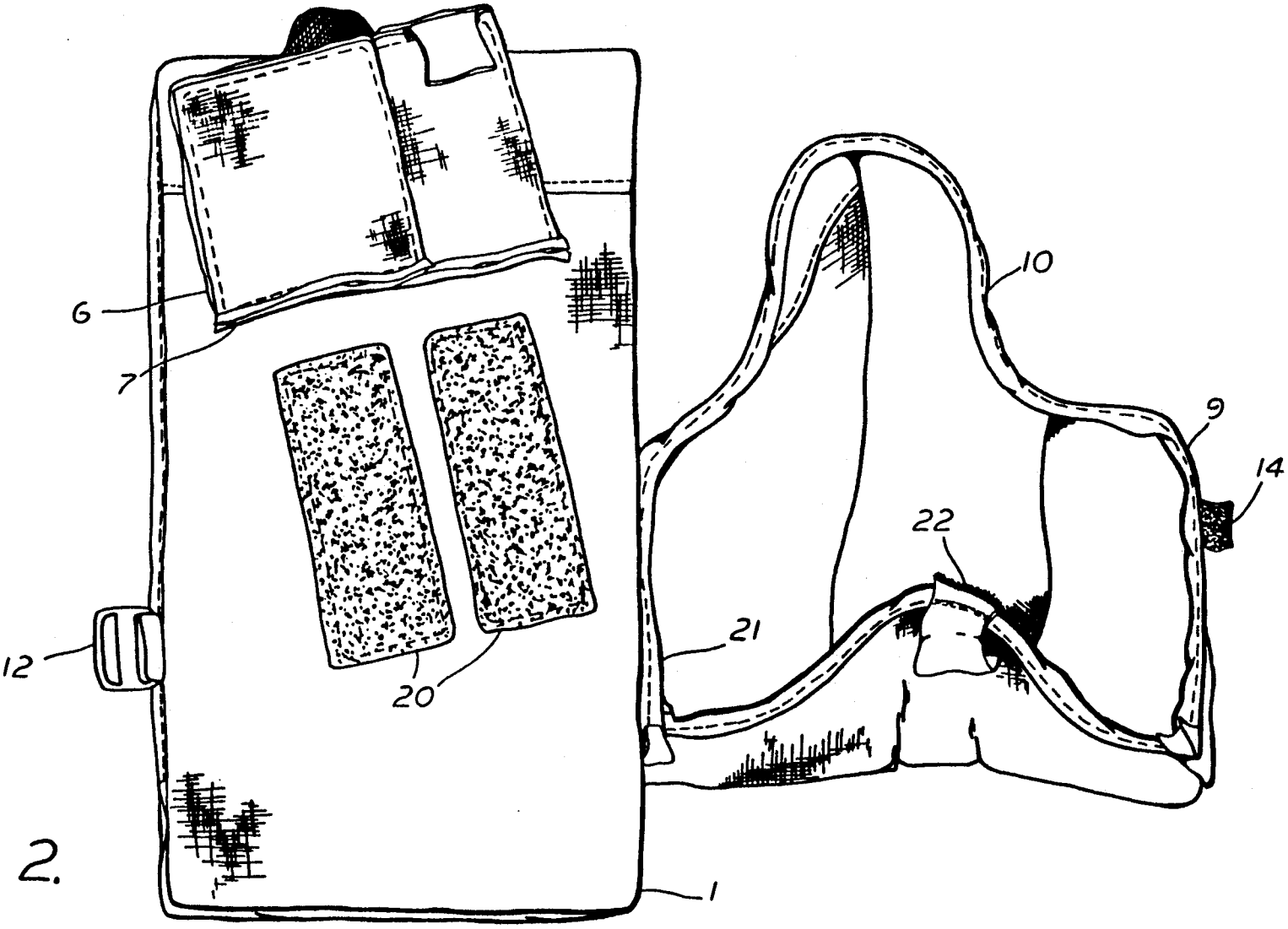
FIG. 2 is a plan view of the blocker pad assembly in open position with the inner glove removed.

Moving to FIG. 2, the blocker back construction can be seen in open view with the inner surface of blocker pad I exposed and the inner glove removed. The rotator pad 6 lays flat against the upper portion of the blocker back 1 and is attached along the length by sewn fabric hinge 7. The wrist strap has been released from the wrist strap buckle 12 and the fastener mating strip 14 on the protector pad 9. Protector pad 9 and its thumb cover extension 10 are now in open position, yet remain attached to the blocker back along sewn fabric hinge 21. A cuff attachment strip 22, also a hook-and-loop fastener device, is shown, and will in later view be shown, to provide an additional attachment to the inner glove construction. A pair of glove attachment strips 20 are shown affixed by sewing to the inside cover of the blocker back 1 and are placed in angular fashion to guide the placement of the inner glove to the correct position. Since these are also hook-and-loop fastener devices, the position of the inner glove may be slightly varied according to the preference of the user by placing the mating surfaces on the back of the inner glove at an angle rather than in registration with the glove attachment strips. The opened blocker back 1 and protector cover 9 construction shown in FIG. 2 illustrates that all of the durable and padded components of the glove are contained within this portion of the device. These are the most expensive and most standardized elements of the overall construction, while the inner glove is the most personalized and subject to direct contact with the user and to moisture absorption, wear, and discomfort such that the life of the outer unit shown in FIG. 2 can be extended dramatically by being able to replace the inner components subject to the most wear. Further, since the device may easily be disassembled and laid out in the fashion of FIG. 2, repairs to the outer portion can be more easily be accomplished as well.

Figure 3:
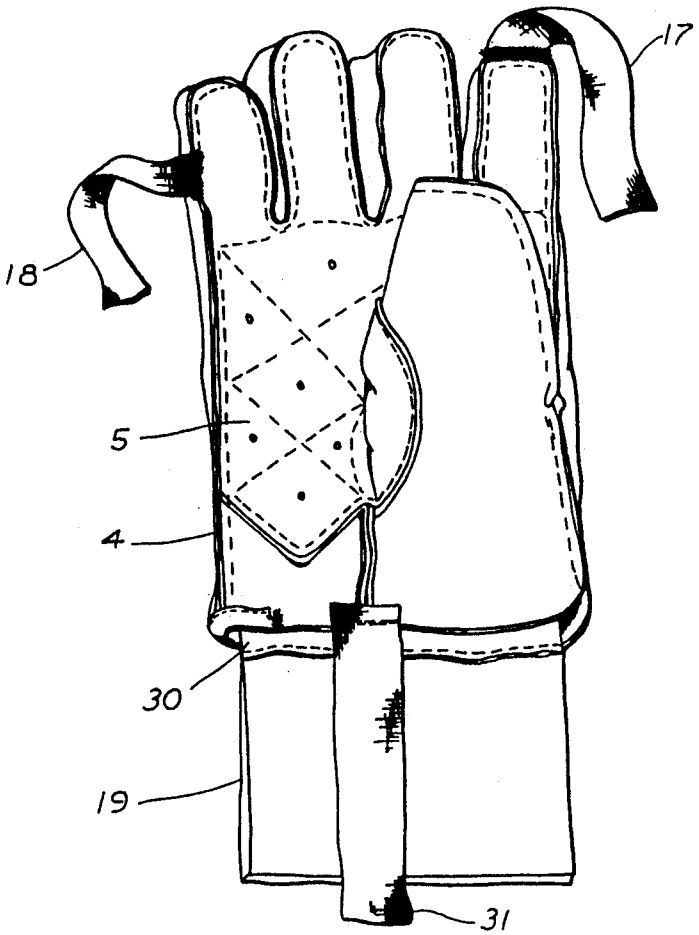
FIG. 3 is a plan view of the palm side of the inner glove.

FIG. 3 illustrates the palm side of the inner replaceable glove construction 4 and the padded ventilated palm 5. The glove back extender pad 19 can now more clearly be seen to consist of a padding material affixed by sewing along line 30 at the outer wrist portion of the glove. Index finger hook-and-loop fastener strap 17 and pinky finger hook-and-loop fastener strap 18 can also be seen now to be permanently affixed to the distal end of the index finger glove portion and the medial section of the pinky finger glove portion. A further securing attachment for the inner glove construction when placed within the blocker back construction is shown as cuff strap 31, again of hook-and-loop fastener material.

Figure 4:
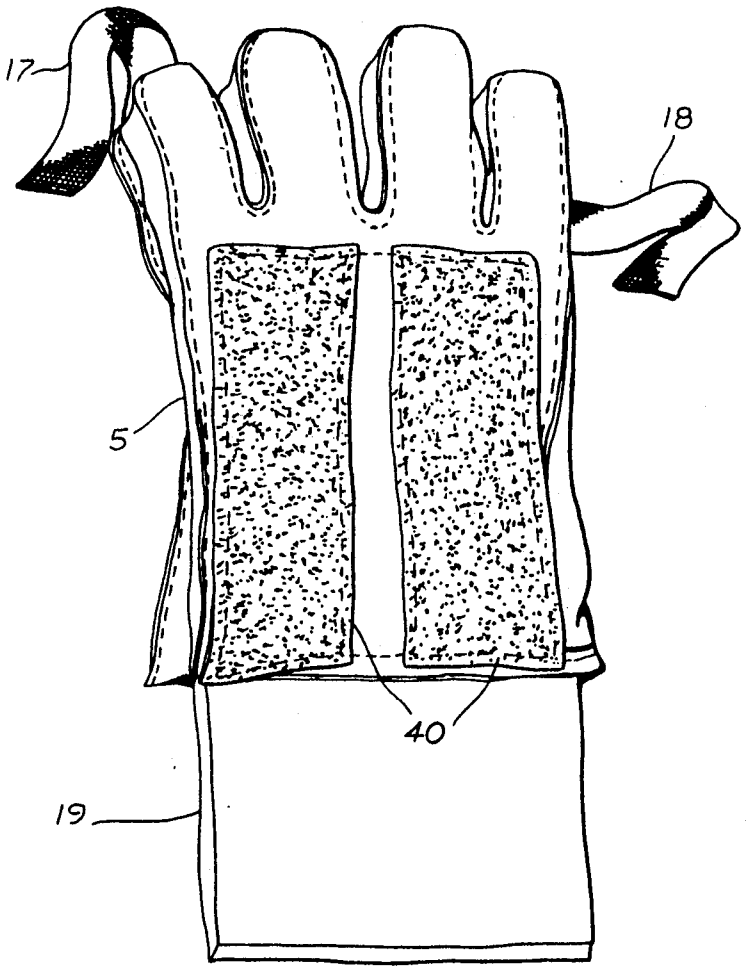
FIG. 4 is a plan view of the back side of the inner glove.

FIG. 4 is backside view of the inner glove 5 showing clearly the glove mating strips 40, which again of hook-and-loop fastener material mate directly with the glove attachment strips 20 as shown in FIG. 2. These provide a very broad mating surface that will securely affix the backside of the inner glove to the inside of the blocker pad, and hook-and-loop fastener finger strips 17 and 18 will affix the phalangeal portion of the inner glove to corresponding fastener strips on the backside of the rotator and finger protector pads, which are in turn affixed to the blocker back. Glove back extender pad 19 can also be seen in this view. It can be seen that this pad will provide further protection and security to the vulnerable backside of the wrist as the hand may be in fully-flexed grasping position exposing that portion underneath the backside of the blocker glove.

From the detailed description provided above, it can be seen that the major objectives of the invention have been achieved, that is the inner glove is fully removable, yet securely attachable, to the protective padding outer construction. Maximum flexibility of motion of the inner glove is maintained without loss of any protective padding extension over the hand, fingers, or wrist areas. Replacement of the inner glove completely or minor repairs or adjustments to the inner glove can be made before it is replaced in the padded outer construction, and repairs to the padded outer construction itself can be more conveniently made with the inner components removed.

While the blocker goalie glove has been illustrated as the embodiment of the invention here reduced to practice, other styles of hockey gloves could also easily be adapted to use the concept illustrated here. For instance, the opposite hand of the goalie would be covered by a catch glove of dramatically different padded constructions yet include all of the inner glove construction and attachment details substantially shown in the preferred embodiment, essentially an inner glove with a broad surface of hook-and-loop fasteners on the backside of the inner glove attached to mating surface in the interior of the padded construction. A wrist strap fastener with an attachment buckle and securing devices would also be provided and phalangeal hook-and-loop mating surfaces and straps configured to maintain flexibility of the inside glove throughout a range of motion while retaining secure attachment and coverage of the outer protector cover.

Having thus described the within invention, I claim:

1. A protective device for hockey players comprising:

an outer padded back, having an inside surface, said back being configured to cover substantially all of the back of a user's fingers, hand, and wrist area;

a glove, comprising a back, a finger portion and a wrist portion, said glove being configured to closely contain said user's hand back, palm, fingers, and thumb;

fastening means to removably secure at least a portion of said back of said glove directly to said inside surface of said outer padded back;

fastening means to removably secure at least a portion of said wrist portion of said glove to said inside surface of said padded back;

strap fastener means to removably secure at least a portion of said wrist portion of said glove to said padded back by passing over said wrist portion and enclosing said wrist portion against said padded back.

2. The device of claim 1 wherein said outer padded back further comprises a hinged phalangeal rotator pad, said pad being fastened to said inside surface of said padded back and being arranged between said inside surface of said padded back and at least a portion of said finger portion of said glove.

3. The device of claim 2 wherein said hinged phalangeal rotator pad is attached to the inside surface of said padded back by a sewn fabric connection.

4. The device of claim 2, comprising a finger restraining means co-acting with said phalangeal rotator pad.

5. The device of claim 3 wherein said finger restraining means comprises hook-and-loop fastener material.

6. The device of claim 3 wherein said finger restraining means comprises a pinky finger restraining means.

7. The device of claim 1 comprising a thumb cover, hinged to said padded back and configured to cover at least a portion of the user's thumb.

8. The device of claim 7 wherein said thumb cover is hinged, by a sewn fabric hinge, to said padded back.

9. The device of claim 7 wherein said thumb cover comprises a strap fastener means to removably secure said thumb cover in protective position.

10. The device of claim 7 comprising retaining means among said protective padded thumb cover and the thumb of said glove.

11. The device of claim 10 wherein said retaining means comprises hook-and-loop fastener material.

12. The device of claim 1 wherein said fastener means to removably secure said back is comprised of hook-and-loop fastening material.

13. The device of claim 1 wherein said fastener means to removably secure said wrist portion is comprised of hook-and-loop fastener material.

14. The device of claim 1 comprising a finger restraining means.

15. The device of claim 14 wherein said finger restraining means comprises an index finger restraining means, coacting with a finger protector pad.

16. The device of claim 1 wherein said strap fastener means to secure said wrist portion of said inner glove comprises hook-and-loop fastener material.

17. The device of claim 1 wherein said strap fastener means comprises a protective pad covering at least a portion of said user's wrist area.

18. A protective blocker glove for hockey goalies comprising:

an outer, generally rectangular, padded back, having an inside surface, said back being configured to cover substantially all of the back of a user's fingers, hand, and wrist area;

an inner glove, comprising a back, a finger portion and a wrist portion, said glove being configured to closely contain said user's hand back, palm, fingers, and thumb;

a hinged phalangeal rotator pad, said pad being arranged between said inside surface of said padded back and at least a portion of said finger portion of said glove;

fastening means to removably secure at least a portion of said back of said glove directly to said inside surface of said outer padded back;

fastening means to removably secure said phalangeal rotator pad to said inside surface of said padded back, between said inside surface of said padded back and at least a portion of said finger portion of said glove;

fastening means to removably secure at least a portion of said wrist portion of said glove to said inside surface of said padded back;

a thumb cover, hinged to said padded back and configured to cover at least a portion of the user's thumb;

strap fastener means to removably secure at least a portion of said wrist portion of said glove to said padded back by passing over said wrist portion and enclosing said wrist portion against said padded back.

19. The glove of claim 18 wherein said thumb cover comprises a strap fastener means to removably secure said thumb cover in protective position.

* * * * *